US007080638B2

(12) United States Patent
Mizutani et al.

(10) Patent No.: US 7,080,638 B2
(45) Date of Patent: Jul. 25, 2006

(54) IGNITION DEVICE FOR INTERNAL COMBUSTION ENGINE

(75) Inventors: Atsuya Mizutani, Yokkaichi (JP); Tetsuya Miwa, Nagoya (JP); Atsushi Iwami, Kariya (JP); Hiromi Hiramatsu, Kariya (JP); Hirofumi Suzuki, Kuwana (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/911,551

(22) Filed: Aug. 5, 2004

(65) Prior Publication Data

US 2005/0045167 A1 Mar. 3, 2005

(30) Foreign Application Priority Data

Aug. 28, 2003 (JP) ..... 2003-304451
Jun. 18, 2004 (JP) ..... 2004-181236

(51) Int. Cl.
*H01F 27/02* (2006.01)
*F02P 3/02* (2006.01)

(52) U.S. Cl. ..... 123/635; 336/96

(58) Field of Classification Search ..... 123/634, 123/635; 336/96, 198, 208, 209
See application file for complete search history.

(56) References Cited

U.S. PATENT DOCUMENTS 4,514,712 A * 4/1985 McDougal ..... 336/96
5,767,758 A * 6/1998 Sakamaki ..... 336/96
6,208,231 B1 * 3/2001 Oosuka et al. ..... 123/634
6,571,784 B1 * 6/2003 Shimada et al. ..... 123/634
6,675,785 B1 1/2004 Miwa et al. ..... 123/635

FOREIGN PATENT DOCUMENTS

| | | |
|---|---|---|
| EP | 0907019 | 4/1999 |
| JP | 11-111545 | 4/1999 |
| JP | 2000-252040 | 9/2000 |
| JP | 2000-277232 | 10/2000 |
| JP | 2002-98507 | 4/2002 |
| JP | 2003-293925 | 10/2003 |

* cited by examiner

*Primary Examiner*—T. M. Argenbright
(74) *Attorney, Agent, or Firm*—Nixon & Vanderhye, PC

(57) ABSTRACT

An internal combustion engine ignition device has a resin layer in a clearance between an insulator and a winding contained in the insulator. The ignition device has a cylindrical insulator and a resin layer. The insulator has an opening portion at one end and a bottom portion at the other end. The insulator contains one of a primary winding and a secondary winding. The resin layer is formed by charging a resin in the clearance between the insulator and one of the windings. The diameter of the inner periphery of the insulator gradually increases from the opening portion to the bottom portion. When the resin layer shrinks from the opening portion toward the bottom portion of the insulator, the resin layer can shrink without getting snagged on the inner periphery of the insulator.

18 Claims, 5 Drawing Sheets

IGNITION DEVICE FOR INTERNAL COMBUSTION ENGINE

CROSS REFERENCE TO RELATED APPLICATIONS

This application is based upon, claims the benefit of priority of, and incorporates by reference Japanese Patent Applications No. 2003-304451 filed Aug. 28, 2003, and No. 2004-181236 filed Jun. 18, 2004.

BACKGROUND OF THE INVENTION

1. Field of the Invention

The teachings of the present invention relates to an internal combustion engine ignition device that has a primary winding and a secondary winding and supplies high voltage to an ignition plug.

2. Description of the Related Art

FIG. 7 shows an ignition device for an internal combustion engine which has been proposed by the present inventors as Japanese Patent Application No. 2002-98507. An ignition coil and an ignition plug are integrated into the ignition device. The ignition device has a cylindrical ceramic insulator 5 around which a primary winding 31 is wound and which contains a secondary winding 32. A resin is charged into a clearance between the insulator 5 and the secondary winding 32 to form a resin layer 9.

SUMMARY OF THE INVENTION

An object of the teachings of the present invention is to provide a winding contained in an insulator in an improved ignition device, in which a resin layer is formed in a clearance between the insulator and the winding contained in the insulator.

According to a first aspect of the teachings of the present invention, an ignition device for an internal combustion engine utilizes a primary winding (31), a secondary winding (32), a cylindrical insulator (5), and a resin layer (9). The primary winding (31) and the secondary winding (32) supply a high voltage to an ignition plug (2). The insulator (5) has an opening portion at one end, and a bottom portion at the other end. The insulator (5) contains one of the primary winding (31) and the secondary winding (32). The resin layer (9) is formed by charging a resin into a clearance between the insulator (5) and the one of the windings. The diameter of the inner periphery of the insulator (5) gradually increases from the opening portion to the bottom portion.

According to the first aspect, since the diameter of the inner periphery of the insulator gradually increases from the opening portion to the bottom portion, the resin layer can shrink without getting snagged on the inner periphery of the insulator when the resin layer shrinks from the opening portion toward the bottom portion of the insulator.

According to a second aspect of the teachings of the present invention, the insulator (5) is engaged with the resin layer (9) in the bottom portion to regulate the movement of the resin layer (9) from the bottom portion toward the opening portion. According to the second aspect, it is possible to shrink the resin layer from the opening portion toward the bottom portion of the insulator.

According a third aspect of the teachings of the present invention, the ignition plug (2) is integrated into the ignition device for the internal combustion engine. The insulator (5) has a winding insulator (52) containing the one of the windings, and a plug insulator (51) containing a center electrode (22) of the ignition plug (2). The winding insulator (52) is joined to the plug insulator (51), and an end of the plug insulator (51) forms the bottom of the winding insulator (52). According to the third aspect, the discrete winding insulator is in the shape of a cylinder both ends of which are open, so that it is possible to easily process the winding insulator into such a shape that the diameter of the inner periphery gradually increases from the opening portion to the bottom portion.

According a fourth aspect of the teachings of the present invention, the resin layer can shrink without getting snagged on the inner periphery of the insulator, when the ignition device satisfies $d2/d1 \geqq 1.01$, wherein d1 represents the diameter of the inner periphery of the opening portion of the insulator (5), and d2 represents the diameter of the inner periphery of the bottom portion of the insulator (5). On the other hand, it is also preferable that the ignition device satisfies $d2/d1 \leqq 1.25$, according to a fifth aspect of the invention, for adding constraints to the dimension of the outside diameter of the insulator.

According to a sixth aspect of the invention, the inner periphery of the insulator (5) may be tapered. Also, an angle of the inner periphery of the insulator (5) with respect to the axis of the insulator (5) may be set to 0.04 degrees or more according to a seventh aspect of the invention. Thereby, the resin layer can shrink without getting snagged on the inner periphery of the insulator. On the other hand, it is preferable that the angle of the inner periphery of the insulator (5) with respect to the axis of the insulator (5) be set to 1 degree or less, according to an eighth aspect of the invention, for adding constraints to the dimension of the outside diameter of the insulator.

According to a ninth aspect of the teachings of the present invention, an ignition device for an internal combustion engine comprises a primary winding (31), a secondary winding (32), a cylindrical insulator (5), and a resin layer (9). The primary winding (31) and the secondary winding (32) supply high voltage to an ignition plug (2). The insulator (5) has an opening portion at one end, and a bottom portion at the other end. The insulator (5) contains one of the primary winding (31) and the secondary winding (32). The resin layer (9) is formed by charging a resin into a clearance between the insulator (5) and one of the windings. In this configuration, the diameter of the inner periphery of the opening portion of the insulator (5) is equal to the diameter of the inner periphery of the bottom portion of the insulator (5).

According to the ninth aspect, the diameter of the inner periphery of the opening portion is equal to the diameter of the inner periphery of the bottom portion in the insulator. Thus, when the resin layer shrinks from the opening portion of the insulator toward the bottom portion thereof, the resin layer can shrink without getting snagged on the inner periphery of the insulator. Therefore, the occurrence of the crack in the resin layer is prevented, and hence it is possible to prevent the break of the winding.

According to a tenth aspect of the invention, an exfoliation member (100) for preventing adhesion between the insulator (5) and the resin layer (9) is disposed between the insulator (5) and the resin layer (9). According to the tenth aspect, when the resin layer hardens and shrinks, the resin layer can easily exfoliate from the insulator. Therefore, the exfoliation member is especially effective at preventing the occurrence of a spiral crack, which may begin at a point of the crack at an end of the resin layer on an opening side.

According to an eleventh aspect of the invention, the exfoliation member (100) is formed by applying one of a glaze, polyethylene, a fluoroplastic, and silicone to the insulator (5). According to a twelfth aspect of the invention, the exfoliation member (100) is a sheet member disposed between the insulator (5) and the resin layer (9). According to the twelfth aspect, it is possible to certainly exfoliate the resin layer from the insulator, as compared with the case of applying the exfoliation member.

According to a thirteenth aspect of the invention, the exfoliation member (100) is provided on the whole surface of the inner periphery of the insulator (5). According to the thirteenth aspect, it is possible to easily exfoliate the resin layer from the insulator on the entire surface across which the resin layer and the insulator are opposed to each other.

According to a fourteenth aspect of the invention, the exfoliation member (100) is provided at the inner periphery of the insulator (5) only on a side close to the opening portion. According to the fourteenth aspect, it is possible to easily carry out a disposing operation of the exfoliation member, as compared with a case in which the exfoliation member (100) is provided on the whole surface of the inner periphery of the insulator.

Further areas of applicability of the teachings of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The teachings of the present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

(First Embodiment)

Figure 1:
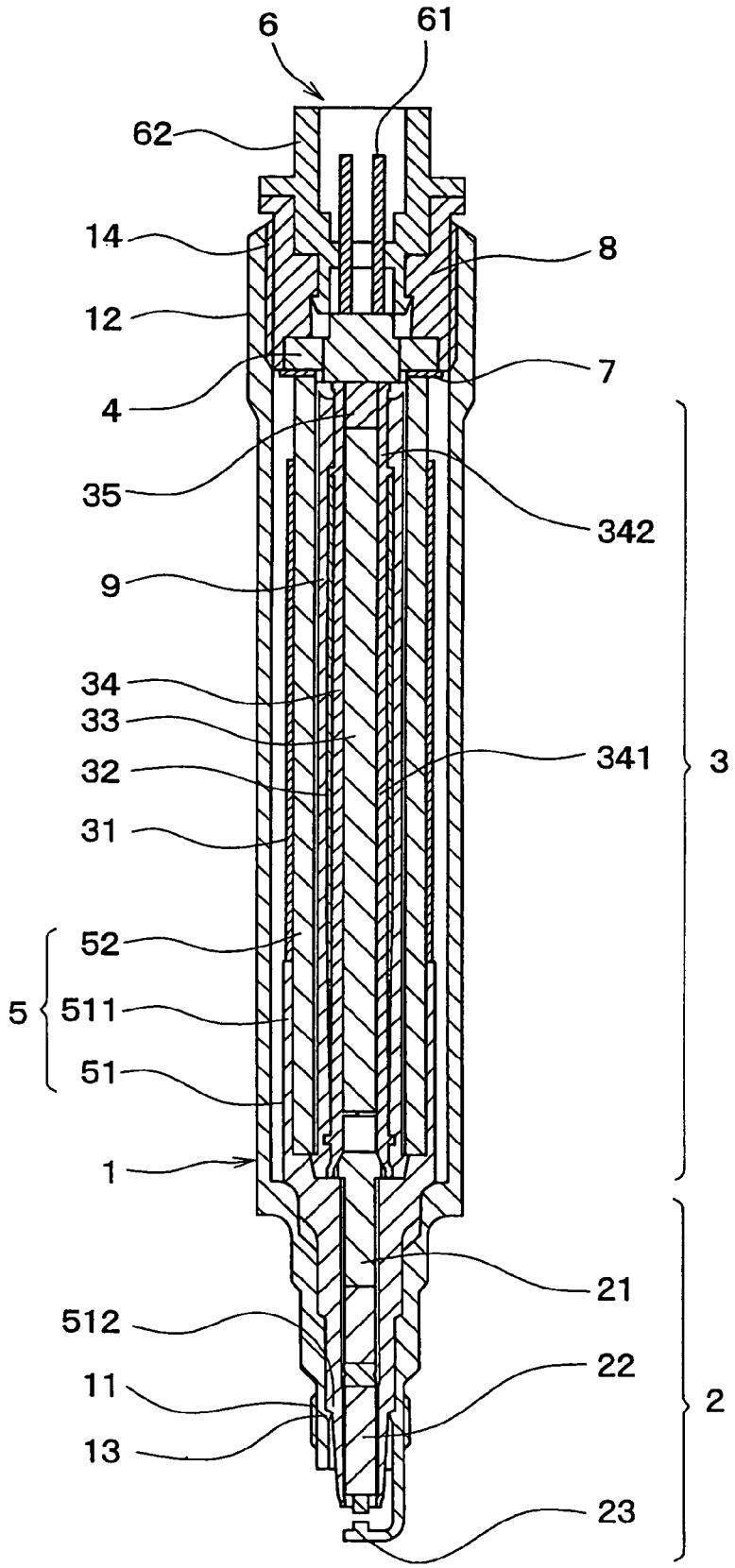
FIG. 1 is a cross-sectional view of an ignition device according to a first embodiment of the teachings of the present invention.
Figure 2:
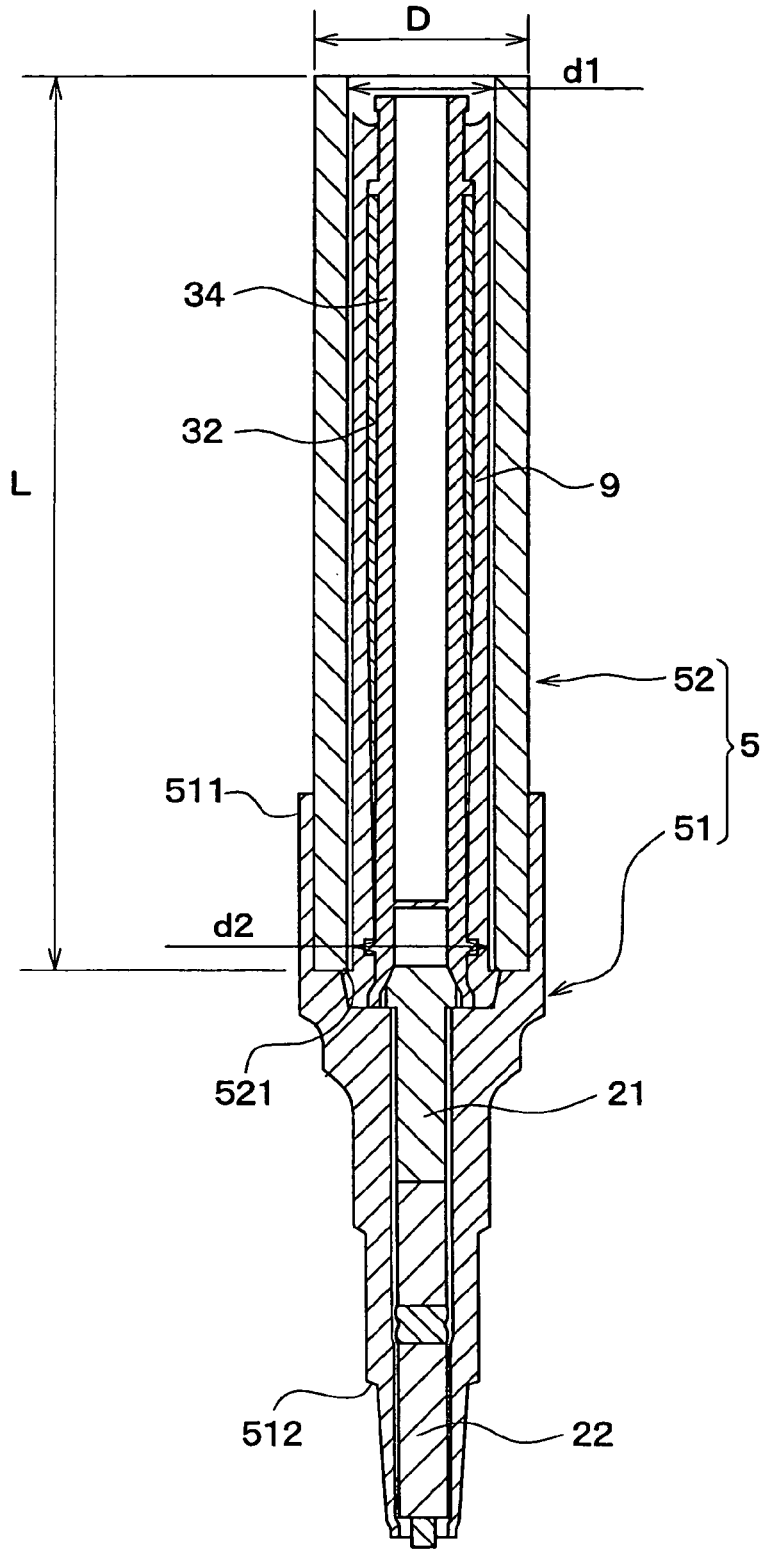
FIG. 2 is a cross-sectional view of the structure of the ignition device of FIG. 1 in the middle of a manufacturing process.
Figure 3:
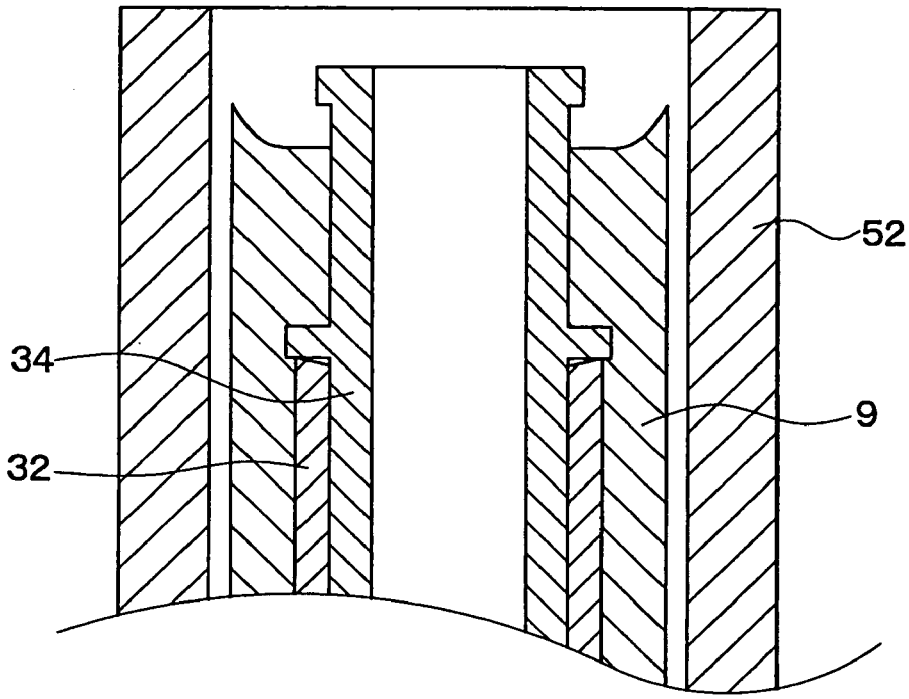
FIG. 3 is an enlarged view of a winding insulator section of FIG. 2.

The teachings of the present invention will be hereinafter described on the basis of embodiments shown in the drawings. FIG. 1 is a cross-sectional view of the entire structure of an ignition device for an internal combustion engine according to a first embodiment of the teachings of the present invention. FIG. 2 is a cross-sectional view of the structure of the ignition device of FIG. 1 in the middle of a manufacturing process, and FIG. 3 is an enlarged view of a winding insulator section of FIG. 2.

Referring to FIG. 1, the ignition device has an ignition plug 2, an ignition coil 3, and a pressure detecting element 4 which are contained in a cylindrical case 1. The ignition device is attached to a plughole of a cylinder head in such a manner that both electrodes (details will be described later) of the ignition plug 2 are exposed to a combustion chamber of the internal combustion engine (not shown) for a vehicle.

The case 1 is made of a magnetic and conductive metal material, and to be more specific, is made of a steel material such as carbon steel. An external thread section 11 is formed in the outer periphery of the case 1 on the side of the combustion chamber, and also a tightening nut section 12 is formed therein on the opposite side of the combustion chamber. The external thread section 11 is screwed into an internal thread section (not shown) of the cylinder head by rotating the case 1 with the use of the nut section 12, so that the ignition device is secured to the cylinder head.

The case 1 contains an insulator 5, which is made of a ceramic electrical insulating material, formed into the shape of a cylinder with a bottom. The insulator 5 has a plug insulator 51 positioned on the side of the combustion chamber, and a winding insulator 52 positioned on the opposite side of the combustion chamber. A primary winding 31 described later is wound around the winding insulator 52. An end of the cylindrical winding insulator 52 is inserted into a cylindrical section 511 of the plug insulator 51, and the plug insulator 51 and the winding insulator 52 are bonded to each other with the use of borosilicate lead glass or the like as an adhesive. The details of the insulator 5 will be described later.

A tiered receiving surface 13 is formed in the inner periphery of the case 1 in the vicinity of the combustion chamber. A tiered contact surface 512 that makes contact with the receiving surface 13 is formed in the outer periphery of the plug insulator 51 of the insulator 5. A metal packing (not shown) intervenes between the receiving surface 13 and the contact surface 512 to prevent the leak of a combustion gas from the clearance between the case 1 and the insulator 5.

The ignition plug 2 has a stem 21 made of a conductive metal, a center electrode 22 made of a conductive metal, an earth electrode 23 made of a conductive metal and the like. The stem 21 and the center electrode 22 are inserted into a center hole of the plug insulator 51 of the insulator 5, and one end of the center electrode 22 is exposed to the combustion chamber. The earth electrode 23 is integrated into the case 1 by welding or the like, and the earth electrode 23 is opposed to the end of the center electrode 22 with a spark gap.

The ignition coil 3 is constituted of the primary winding 31, a secondary winding 32, a center core 33, a secondary spool 34 and the like. The center core 33 is made of a magnetic material into the shape of a cylindrical column. The secondary spool 34 is made of an electrical insulating resin into the shape of a cylinder with a bottom. The primary winding 31 is directly wound around the outer periphery of the winding insulator 52 of the insulator 5. Both ends of the primary winding 31 are connected to connecter terminals 61 of a connector 6 via terminals (not shown). Thus, a control signal from an igniter (not shown) is inputted into the primary winding 31.

In the case 1, an area surrounding the center core 33 has the function of a peripheral core through which magnetic flux flows. The magnetic flux generated by the primary winding 31 flows through the center core 33 and the case 1. In the case 1, a slit (not shown) which extends in the axial direction of the center core 33 is formed in the area surrounding the center core 33, in order to prevent loss caused by a ring current occurring due to variation in the magnetic flux.

The secondary spool 34 has a winding tube section 341 around which the secondary winding 32 is wound, and a protruding tube section 342 which protrudes from the winding tube section 341 to the opposite side of the combustion chamber. The secondary winding 32 is wound around the outer periphery of the winding tube section 341. The center core 33 is inserted into the center hole of the secondary spool 34. After the center core 33 is inserted, a core pressing cap 35 made of an elastic material such as rubber and sponge is inserted into an opening portion of the center hole of the secondary spool 34, so that the center hole of the secondary spool 34 is clogged. A resin which has an excellent electrical insulation property such as, for example, an epoxy resin is charged into the clearance between the winding insulator 52 and the secondary winding 32 in the insulator 5, in order to form the resin layer 9.

A high voltage end of the secondary winding 32 is electrically connected to the center electrode 22 through the stem 21 of the ignition plug 2, and a low voltage end thereof is connected to the case 1 through a terminal (not shown). The case 1 is grounded to a body (not shown) of a vehicle through the cylinder head and the like.

Voltage outputted from the pressure detecting element 4 varies in accordance with variation in a load applied thereto. The pressure detecting element 4 is made of, for example, lead titanate into the shape of a thin ring plate. The pressure detecting element 4 is disposed at an end of the winding insulator 52. An end of the pressure detecting element 4 is electrically connected to the cylinder head through a bolt 8 and the case 1.

A terminal 7, which is made of a conductive metal into the shape of a thin ring plate, for signaling combustion pressure, is disposed between the pressure detecting element 4 and the end of the winding insulator 52. A connector terminal 61 is integrally formed in the terminal 7 for signaling the combustion pressure. Thus, an output signal from the pressure detecting element 4 is outputted to a control unit (not shown).

The bolt 8 is made of a conductive metal into a cylindrical shape. Since the bolt 8 is screwed into an internal thread section 14 which is formed in the case 1 on the opposite side of the combustion chamber, the pressure detecting element 4 and the terminal 7 for signaling the combustion pressure are held between the end of the winding insulator 52 and the bolt 8.

When the bolt 8 is tightened, a compression preload is applied to the pressure detecting element 4, and also the combustion gas is prevented from leaking from the clearance between the case 1 and the insulator 5 in a contact portion among the receiving surface 13 of the case 1, the contact surface 512 of the insulator 5, and the packing (not shown). After the bolt 8 is screwed into the internal thread section 14, a resin case 62 of the connector 6 is inserted into a hollow of the bolt 8.

In the ignition device having the foregoing structure, the ignition coil 3 generates a high voltage on the basis of the control signal from the igniter, and the ignition plug 2 discharges the high voltage in the spark gap to ignite an air flow mixture in the combustion chamber. Pressure generated by combustion in the combustion chamber is transmitted to the pressure detecting element 4 through the insulator 5, and hence the pressure detecting element 4 receives a compression load. Then, the pressure detecting element 4 outputs an output signal of voltage in accordance with variation in the load.

Next, characteristics of this embodiment will be described.

When the plug insulator 51 is joined to the winding insulator 52, as shown in FIG. 2, the end of the winding insulator 52 is clogged by the plug insulator 51. In other words, one end of the plug insulator 51 forms a bottom portion of the winding insulator 52. The inner periphery of the end of the winding insulator 52, which inwardly protrudes from the plug insulator 51, forms an engagement section 521. A resin of the resin layer 9 flowing into the clearance between the engagement section 521 and the plug insulator 51 engages with the engagement section 521, so that the movement of the resin layer 9 from the bottom portion toward an opening portion of the winding insulator 52 is regulated.

The inner periphery of the winding insulator 52 is tapered, and the diameter of the inner periphery of the winding insulator 52 gradually increases from the opening portion to the bottom portion thereof. Since the diameter of the inner periphery of the winding insulator 52 gradually increases from the opening portion to the bottom portion, as described above, when the resin layer 9 shrinks from the opening portion toward the bottom portion of the winding insulator 52, the resin layer 9, as shown in FIG. 3, exfoliates from the inner periphery of the winding insulator 52. Thus, the resin layer 9 can shrink without getting snagged on the inner periphery of the winding insulator 52. Therefore, a crack is prevented from occurring in the resin layer 9, and hence no breaks of the secondary winding 32 will occur.

Next, an embodiment of a tapered section of the winding insulator 52 will be described. To make the resin layer 9 easily exfoliate from the inner periphery of the winding insulator 52 and prevent the resin layer 9 from getting snagged thereon when the resin layer 9 shrinks, it is preferable that the winding insulator 52 is formed to satisfy the following equation, $d2/d1 \geqq 1.01$, wherein d1 represents the diameter of the inner periphery of the opening portion of the winding insulator 52, and d2 represents the diameter of the inner periphery of the bottom portion of the winding insulator 52. It is also preferable that the winding insulator 52 is formed so as to satisfy the following equation, $d2/d1 \leqq 1.25$, for adding constraints to the dimension of the outside diameter of the winding insulator 52.

Representing the foregoing conditions by an angle of the inner periphery of the winding insulator 52 with respect to the axis of the winding insulator 52 (hereinafter called the gradient of the inner periphery of the winding insulator 52), it is preferable that the gradient of the inner periphery of the winding insulator 52 be set to 0.04 degrees or more, to make the resin layer 9 easily exfoliate from the inner periphery of the winding insulator 52 and prevent the resin layer 9 from getting snagged thereon when the resin layer 9 shrinks. It is also preferable that the gradient of the inner periphery of the winding insulator 52 be set to 1 degree or less, for adding the constraints to the dimension of the outside diameter of the winding insulator 52.

Furthermore, here is a specific example of the dimensions of the winding insulator 52. When, for example, d1=ϕ10.3 mm, D1=ϕ13.8 mm and L=82.5 mm, it is preferable that d2=ϕ10.54 to 10.78 mm, wherein D represents the outside diameter of the winding insulator 52 and L represents the whole length of the winding insulator 52.

(Second Embodiment)

Figure 4:
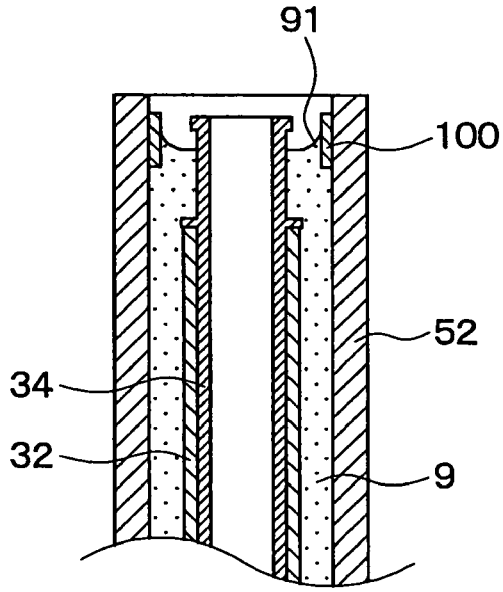
FIG. 4 is a cross-sectional view of an ignition device according to a second embodiment of the teachings of the present invention.

A second embodiment of the teachings of the present invention will be described. FIG. 4 is a cross-sectional view of a winding insulator section of an ignition device for an internal combustion engine according to the second embodiment. In this embodiment, an exfoliation member 100 is added to the ignition device of the internal combustion engine according to the first embodiment, and the remaining structure is the same as that of the first embodiment.

Adhesion at an end 91 of a resin layer 9 on the side of an insulator opening portion (hereinafter called an end of the resin layer on an opening side) is higher than that at the other areas, as described above. In this embodiment, the exfoliation member 100 is disposed between the resin layer 9 and the winding insulator 52 in order to prevent adhesion between the resin layer 9 and the winding insulator 52, and to easily exfoliate the resin layer 9 from the winding insulator 52 when the resin layer 9 hardens and shrinks. To be more specific, the exfoliation member 100 is provided in the inner periphery of the winding insulator 52 only on a side close to the opening portion, and is provided at an area including at least the end 91 of the resin layer 9 on the opening side.

In this embodiment, the exfoliation member 100 is formed by applying a glaze to the inner periphery of the winding insulator 52. The glaze is applied by use of a rod-like member which is impregnated with the glaze. According to this embodiment, the exfoliation member 100 prevents adhesion between the resin layer 9 and the winding insulator 52, so that the resin layer 9 easily exfoliates from the winding insulator 52 when the resin layer 9 hardens and shrinks.

The exfoliation member 100 may be formed by applying polyethylene, fluoroplastics (PTFE), silicone and the like instead of the glaze. Otherwise, a sheet member such as a sheet of paper disposed between the resin layer 9 and the winding insulator 52 may be used as the exfoliation member 100.

The exfoliation member 100 may be provided on the whole surface of the inner periphery of the winding insulator 52. By flowing the glaze or the like into the winding insulator 52, it is possible to provide the exfoliation member 100 on the whole surface of the inner periphery of the winding insulator 52.

(Other Embodiments)

Figure 5:
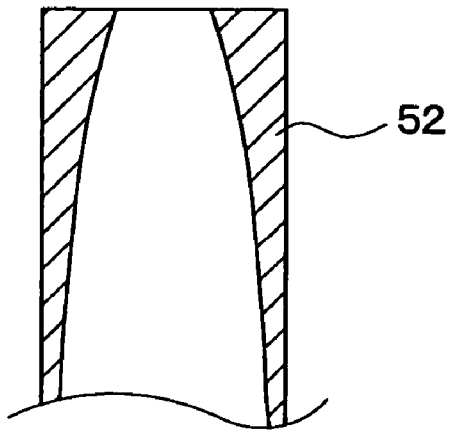
FIG. 5 is a cross-sectional view of an essential portion of an ignition device according to another embodiment of the teachings of the present invention.
Figure 6:
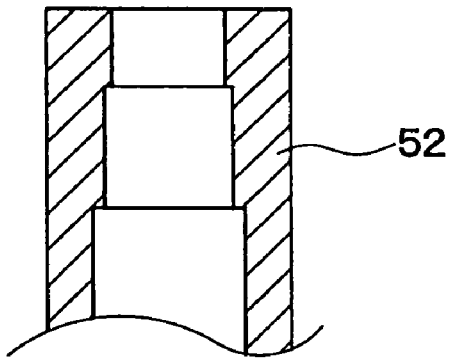
FIG. 6 is a cross-sectional view of an essential portion of an ignition device according to another embodiment of the teachings of the present invention.
Figure 7:
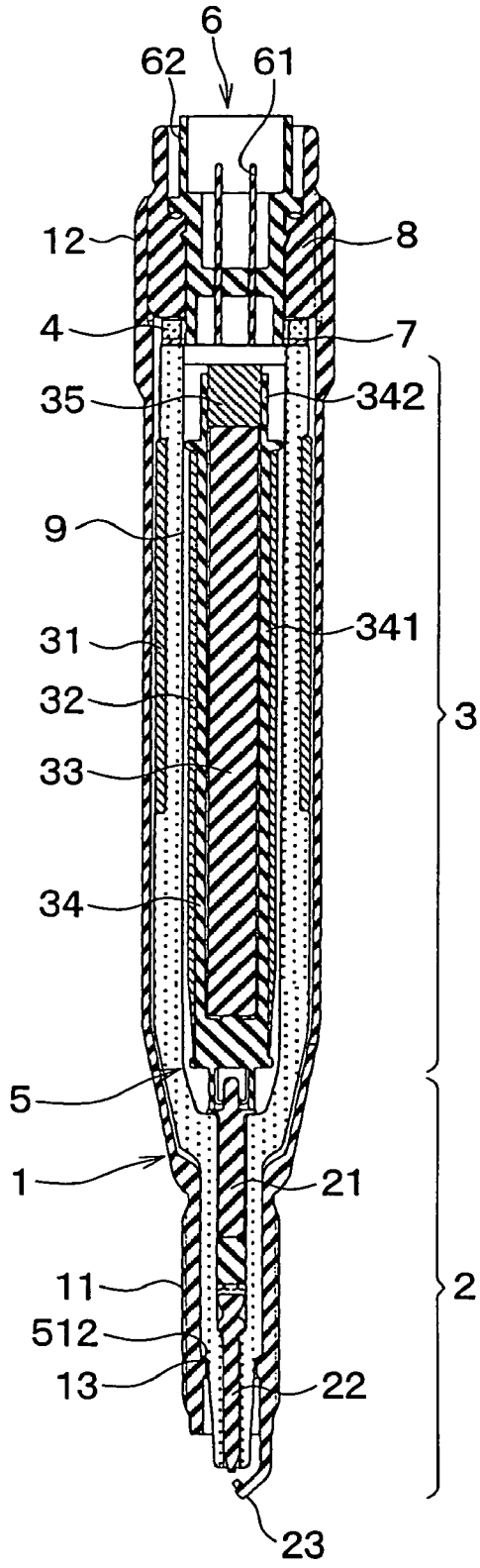
FIG. 7 RELATED ART
FIG. 7 is a cross-sectional view of an ignition device of the related art.

In the foregoing embodiments, the inner periphery of the winding insulator 52 is tapered. The inner periphery of the winding insulator 52 may be in the shape of, for example, a curve as shown in FIG. 5, or steps as shown in FIG. 6, as long as the diameter of the inner periphery of the winding insulator 52 gradually increases from the opening portion to the bottom portion thereof. Furthermore, $d2>d1$ is satisfied in the foregoing embodiments. Even if $d2=d1$, however, it is possible to shrink the resin layer 9 without getting snagged on the inner periphery of the winding insulator 52.

In the foregoing embodiments, the secondary winding 32 is positioned on an inner peripheral side, and the primary winding 31 is positioned on an outer peripheral side, but the teachings of the present invention are not limited to such. The secondary winding 32 may be positioned on the outer peripheral side, and the primary winding 31 may be positioned on the inner peripheral side.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An internal combustion engine ignition device comprising:

a primary winding and a secondary winding for supplying a high voltage to an ignition plug;

a cylindrical insulator having an opening portion at one end, and a bottom portion at the other end, the insulator containing one of the primary winding and the secondary winding; and a resin layer that is formed by charging a resin into a clearance defined between the insulator and the one of the windings, wherein a diameter of an inner periphery of the insulator gradually increases from the opening portion to the bottom portion.

2. The ignition device according to claim 1, wherein the insulator is engaged with the resin layer in the bottom portion to regulate the movement of the resin layer from the bottom portion toward the opening portion.

3. The ignition device according to claim 1, wherein the ignition plug is integrated into the ignition device, the insulator comprises a winding insulator containing the one of the windings, and a plug insulator containing a center electrode of the ignition plug, and the winding insulator is joined to the plug insulator, an end of the plug insulator forming the bottom of the winding insulator.

4. The ignition device according to claim 1, wherein the ignition device satisfies $d2/d1 \geqq 1.01$, wherein d1 represents the diameter of the inner periphery of the opening portion of the insulator, and d2 represents the diameter of the inner periphery of the bottom portion of the insulator.

5. The ignition device according to claim 4, wherein the ignition device satisfies $d2/d1 \leqq 1.25$.

6. The ignition device for an internal combustion engine according to claim 1, wherein the inner periphery of the insulator is tapered.

7. The ignition device for an internal combustion engine according to claim 6, wherein an angle of the inner periphery of the insulator with respect to an axis of the insulator is set to 0.04 degrees or more.

8. The ignition device according to claim 7, wherein the angle of the inner periphery of the insulator with respect to the axis of the insulator is set to 1 degree or less.

9. An internal combustion engine ignition device comprising:

a primary winding and a secondary winding for supplying a high voltage to an ignition plug;

a cylindrical insulator having an opening portion at one end, and a bottom portion at the other end, the insulator containing one of the primary winding and the secondary winding;

a resin layer that is formed by charging a resin into a clearance defined between the insulator and the one of the windings, wherein a diameter of an inner periphery of the opening portion of the insulator is equal to a diameter of an inner periphery of the bottom portion of the insulator; and an exfoliation member for preventing adhesion between the insulator and the resin layer disposed between the insulator and the resin layer.

10. The ignition device according to claim 9 wherein the exfoliation member is formed by applying one selected from the group consisting of a glaze, polyethylene, a fluoroplastic, and silicone to the insulator.

11. The ignition device according to claim 9 wherein the exfoliation member is a sheet member disposed between the insulator and the resin layer.

12. The ignition device according to claim 9 wherein the exfoliation member is provided on the whole surface of the inner periphery of the insulator.

13. The ignition device according to claim 9 wherein the exfoliation member is provided in the inner periphery of the insulator only on a side close to the opening portion.

14. An internal combustion engine ignition device comprising:

a primary winding and a secondary winding for supplying a high voltage to an ignition plug;

a cylindrical insulator having an opening portion at one end, and a bottom portion at the other end, the insulator containing one of the primary winding and the secondary winding; and a resin layer that is formed by charging a resin into a clearance defined between the insulator and the one of the windings, wherein the cylindrical insulator is made of ceramic material, and wherein a diameter of an inner periphery of the insulator gradually increases from the opening portion to the bottom portion.

15. The ignition device according to claim 1, wherein the inner periphery of the insulator is in the shape of a curve.

16. The ignition device according to claim 1, wherein the inner periphery of the winding insulator increases in steps.

17. The ignition device according to claim 14 wherein the inner periphery of the insulator is in the shape of a curve.

18. The ignition device according to claim 14 wherein the inner periphery of the winding insulator increases in steps.

* * * * *